US007965272B2

(12) United States Patent
Eom

(10) Patent No.: US 7,965,272 B2
(45) Date of Patent: Jun. 21, 2011

(54) ORGANIC LIGHT EMITTING DISPLAY

(75) Inventor: Ki Myeong Eom, Youngin-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 969 days.

(21) Appl. No.: 11/892,077

(22) Filed: Aug. 20, 2007

(65) Prior Publication Data

US 2008/0170009 A1 Jul. 17, 2008

(30) Foreign Application Priority Data

Aug. 18, 2006 (KR) ..... 10-2006-0078063

(51) Int. Cl.
*G09G 3/36* (2006.01)

(52) U.S. Cl. ..... 345/98; 345/100

(58) Field of Classification Search ..... 345/76–83, 345/98, 100

See application file for complete search history.

(56) References Cited

U.S. PATENT DOCUMENTS 5,781,171 A * 7/1998 Kihara et al. ..... 345/100
7,427,971 B2 9/2008 Eom
2005/0206608 A1* 9/2005 Murade ..... 345/103
2005/0212446 A1 9/2005 Eom
2006/0125766 A1* 6/2006 Senda et al. ..... 345/100

FOREIGN PATENT DOCUMENTS

CN 1 674 074 A 9/2005
JP 2006-058898 A 3/2006
JP 2006-216093 A 8/2006
KR 10-2005-0094668 9/2005
KR 10-2006-0025282 3/2006

* cited by examiner

*Primary Examiner* — Kevin M Nguyen
(74) *Attorney, Agent, or Firm* — Lee & Morse, P.C.

(57) ABSTRACT

An organic light emitting display operates on at least two different selection signals, which may perform a bi-directional scan that allows a double-sided screen to be displayed. The organic light emitting display includes a data line, first and second scan lines, a bi-directional data driver for applying a data signal in both directions, a first scan driver adapted to receive a forward or reverse signal and to selectively output a first selection signal having a forward or reverse direction to the first scan line in accordance with the forward or reverse signal, and a second scan driver adapted to receive the first selection signal and to selectively output a second selection signal of a forward or reverse direction to the second scan line in accordance with the forward or reverse signal.

18 Claims, 8 Drawing Sheets

ORGANIC LIGHT EMITTING DISPLAY

BACKGROUND OF THE INVENTION

1. Field of the Invention

The present invention relates to an organic light emitting display. More particularly, the present invention relates to an organic light emitting display capable of changing a display direction so as to permit a double-sided display.

2. Description of the Related Art

In general, an organic light emitting display electrically excites an organic phosphor to emit light by using voltage or current to drive M×M organic emitting cells arranged in an array to display images.

Since such an organic emitting cell has diode characteristics, it may be referred to as an organic light emitting diode (OLED). As shown in FIG. 1, the organic emitting cell may include an anode of indium tin oxide (ITO), an organic thin film, and a cathode layer. The organic thin film may have a multi-layer structure including an emitting layer (EML), an electron transport layer (ETL), and a hole transport layer (HTL) for maintaining balance between electrons and holes and for improving emitting efficiencies. The organic thin film may further include an electron injection layer (EIL) and a hole injecting layer (HIL). Additionally a metal cathode may be present.

FIG. 2 illustrates a partial perspective view schematically depicting an OLED capable of providing a double-sided display. The OLED may include a first transparent electrode 24, an emission layer 38, and a second transparent electrode 36, which are arranged between an upper transparent substrate 40 and a lower transparent substrate 22.

The first transparent electrode 24 may include an anode electrode formed on a lower glass substrate 22 by, e.g., vacuum-depositing or sputtering one of Indium-Tin-Oxide (ITO), Indium-Zinc-Oxide (IZO), or Indium-Tin-Zinc-Oxide (ITZO). The first transparent electrode 24 may used as a data electrode.

The emission layer 38 may include a hole injection layer 26, a hole transport layer 28, an organic emission layer 30, an electron transport layer 32, and an electron injection layer 34, which may be sequentially laminated on the first transparent electrode 24.

The second transparent electrode 36 may be a cathode electrode formed on the emission layer 38 by, e.g., vacuum-deposition or sputtering one of ITO, IZO, or ITZO.

The first transparent electrode 24 and the second transparent electrode 36 may have differently set work functions according to a composition ratio of an oxide and $O_2$ plasma process. Accordingly, one of the work functions of the first transparent electrode 24 and the second transparent electrode 36 may be set lower than the other so that electrons and holes move. Owing to a difference between the work function of the first transparent electrode 24 and the work function of the second transparent electrode 36, the organic emission layer 38 may emit light using holes and electrons supplied from the first transparent electrode 24 and the second transparent electrode 36.

Visible light generated from the organic emission layer 30 may be discharged in both directions through the first and second transparent electrodes 24 and 36, and the upper and lower glass substrates 40 and 22. Accordingly, an electroluminescent (EL) device having a double-sided display function including the OLED may display an image in both front and rear directions.

FIG. 3 illustrates a schematic view of an organic light emitting display including the OLED shown in FIG. 2.

As shown in FIG. 3, the organic light emitting display may include an organic EL display panel 100, a scan driver 200, and a data driver 300.

The organic EL display panel 100 may include multiple data lines D1 to Dm, multiple scan lines S1 to Sn, and multiple pixel circuits 110. The data lines D1 to Dm may be arranged in a row direction, and the of scan lines S1 to Sn may be arranged in a column direction. The data lines D1 to Dm may transfer a data signal indicating an image signal to the pixel circuits 110. The scan lines S1 to Sn may transfer a selection signal to the pixel circuits 110. Each of the pixel circuits 100 may be formed at a pixel region, which may be defined by two adjacent data lines D1 to Dm and two adjacent scan lines S1 to Sn. Hereinafter, a pixel connected to a first scan line S1 is referred to as "P1", and a pixel connected to an n-th scan line Sn is referred to as "Pn."

The scan driver 200 may sequentially apply the selection signal to the scan lines S1 to Sn, respectively. The data driver 300 may apply a data voltage corresponding to the image signal to the data lines D1 to Dm.

The scan driver 200 and/or the data driver 300 may be electrically connected to the organic EL display panel 100. Further, the scan driver 200 and/or the data driver 300 may be coupled to the organic EL display panel 100 and may be mounted on a tape carrier package (TCP) in a form of a chip, which may be electrically connected thereto. Otherwise, the scan driver 200 and/or the data driver 300 may be coupled to the organic EL display panel 100 by mounting on a flexible printed circuit (FPC) or a film in a form of a chip, which may be electrically connected thereto. In contrast to this, the scan driver 200 and/or the data driver 300 may be directly mounted on a glass substrate. Also, the scan driver 200 and/or the data driver 300 may be substituted by a driving circuit or may be directly mounted on the driving circuit, which may be formed on the same layer as that of the scan lines S1 to Sn, the data lines D1 to Dm, and a thin film transistor.

On the other hand, in the organic EL display having a double-sided display function, the left and right of the front screen and the rear screen may reverse. Thus, in order to match a screen displayed on a rear surface of a display device with a front surface thereof, a first data signal may be applied to the first data line D1 in the front display and to the m-th data line Dm in the rear display. Further, an m-th data signal may be applied to the m-th data line in the front display and to the first data line D1 in the rear display.

Similar to a rotation of 180 degrees, besides the left and the right of a screen in the display panel, when a top and a bottom of the display panel reverse, as in the data driver, a scan driver may include a bi-directional shift register, which applies a data signal in a bi-directional manner. Namely, an emission display device in which a display screen rotates at 180 degrees may use a bi-directional scan driver to display the screens before and after rotation to thus be equally displayed. In this case, the bi-directional scan driver may apply a first selection signal to the first scan line S1 when the selection signal is sequentially applied from an upper side to a lower side (referred to as "forward scan" hereinafter), and to the n-th scan line Sn when the selection signal is sequentially applied from a lower side to an upper side (referred to as "reverse scan" hereinafter). Further, the bi-directional scan driver may apply an n-th selection signal to the n-th scan line Sn during the forward scan, and to the first scan line S1 during the reverse scan.

However, the pixel circuit may operate based on at least two different selection signals, e.g., an n-th selection signal applied to the current scan line Sn and an n−1-th selection signal applied to the previous scan line Sn−1. The aforementioned pixel circuit may have an arrangement structure, which may normally operate by applying the n-th selection signal to the n-th scan line Sn after an n−1-th selection signal was applied to an n−1-th scan line Sn−1 during the forward scan. In contrast, during the reverse scan, an applying direction of a scan line may be reversed. Accordingly, after the first selection signal was applied to the n-th scan line Sn, a second selection signal may be applied to the n−1-th scan line Sn−1, so that the pixel circuit may fail to normally operate.

The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention is therefore directed to an organic light emitting display including a pixel circuit operating based on at least two different selection signals, which substantially overcomes one or more of the problems due to the limitations and disadvantages of the related art.

It is therefore a feature of an embodiment of the present invention to provide a display, which may perform a bi-directional scan that allows a double-sided screen to be displayed.

At least one of the above and other features and advantages of the present invention may be realized by providing an organic light emitting display which may include a display panel including pixel circuits, a data line, and first and second scan lines, a bi-directional data driver adapted to apply a data signal in both directions, a first scan driver adapted to receive a forward or reverse signal and to selectively output a first selection signal in a forward or reverse direction to the first scan line in accordance with the forward or reverse signal, and a second scan driver adapted to receive the first selection signal and to selectively output a second selection signal in the forward or reverse direction to the second scan line accordance with the forward or reverse signal.

The first and second scan drivers may be at both sides of the display panel, respectively. The first scan driver may include a scan direction controller adapted to receive the forward or reverse signal, and to cause a shift register of a next stage to generate a sequential signal in the forward or reverse direction, a shift register adapted to shift a start signal received by the scan direction controller to generate the sequential signal, and a first selection signal supply section adapted to receive one of two adjacent signals, and first and second clock signals from the shift register and to provide the first selection signal to the first scan line. The display may further include a buffer section between the first selection signal supply section and the display panel. The scan direction controller may include of control units, each control unit having a first transistor adapted to be turned-on according to the forward signal to provide the start signal or an output signal of a shift register in a previous stage to a shift register unit, and a second transistor adapted to be turned-on according to the reverse signal to provide the start signal or an output signal of a shift register unit in a next stage to the shift register unit. The first and second transistors may be different types from each other. The first selection signal supply section may include three terminal NAND gates, which may be adapted to receive one of two adjacent signals, and first and second clock signals from the shift register. The first and second clock signals may have a time period of 1H, and the phases thereof may be inverted and input.

The second scan driver may include a second signal selection supply section, which outputs a first previous selection signal of the first scan driver as a second selection signal in response to the forward signal, and may output a first next selection signal of the first scan driver as the second selection signal in response to the reverse signal. The display may further include a buffer section between the second signal selection supply section and the display panel. The second signal selection supply section may include selection units, each having a first transistor adapted to be turned-on according to the forward signal for providing a first previous selection signal of the first scan driver as a second selection signal, and a second transistor adapted to be turned-on according to the reverse signal for providing a first next selection signal of the first scan driver as the second selection signal. The first and second transistors may be different types from each other. The first scan line may include current scan lines S0, S1*b*, S2*b* . . . Snb, Sn+1, which may be connected to respective pixel circuits of the display panel, and the first scan line may include previous scan lines, which may be connected to the respective pixel circuits of the display panel. The S0 and Sn+1 scan lines of the first scan line may be dummy scan lines, and any pixel connected to the dummy scan lines may emit substantially no light.

At least one of the above and other features and advantages of the present invention may be realized by providing a driver for a display which may include a bi-directional data driver adapted to apply a data signal in both directions, a first scan driver adapted to receive a forward or reverse signal and to output a first selection signal in a forward or reverse direction to a first scan line of a display panel, and a second scan driver adapted to receive the first selection signal and to output a second selection signal in the forward or reverse direction to a second scan line of the display panel.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
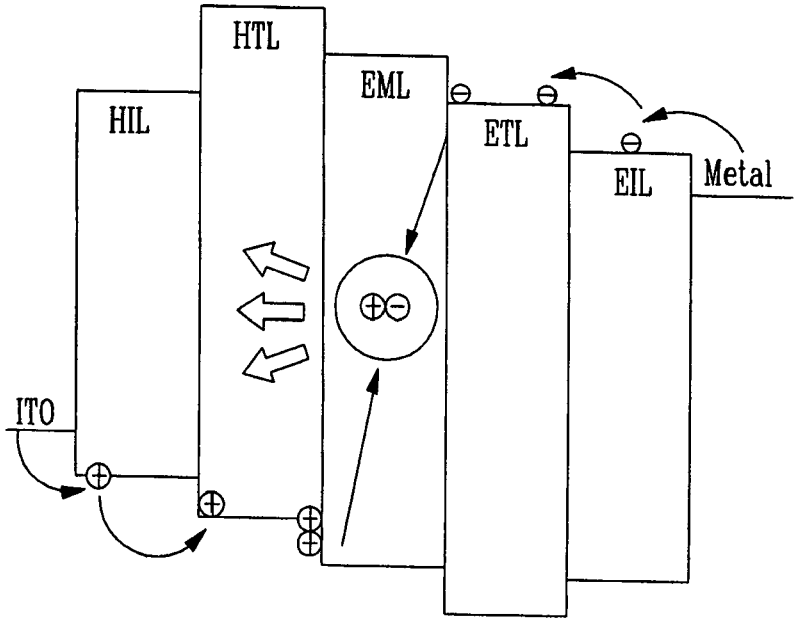
FIG. 1 RELATED ART
FIG. 1 illustrates a view of a concept of an OLED.
Figure 2:
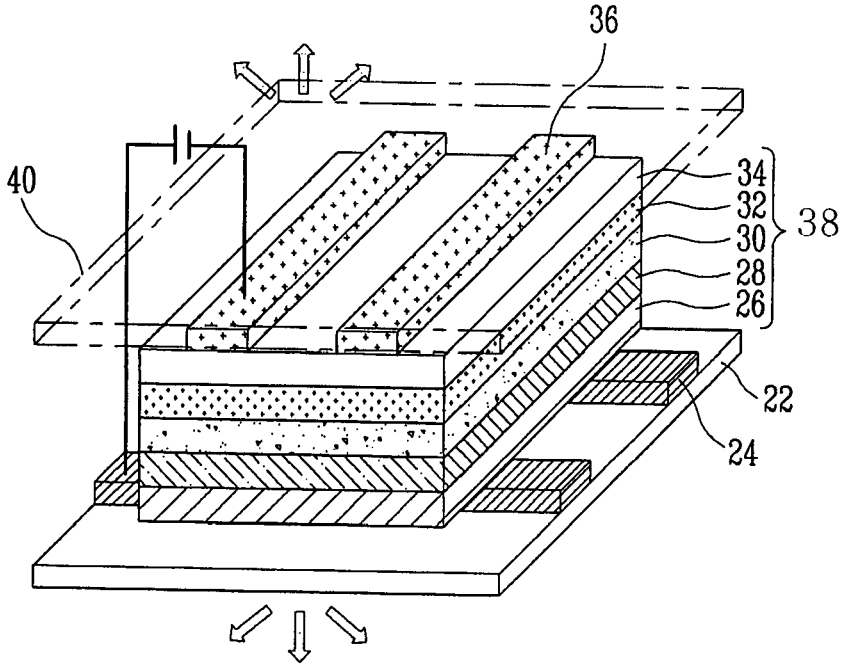
FIG. 2 RELATED ART
FIG. 2 illustrates a partial perspective schematic view of an OLED capable of providing a double-sided display.
Figure 3:
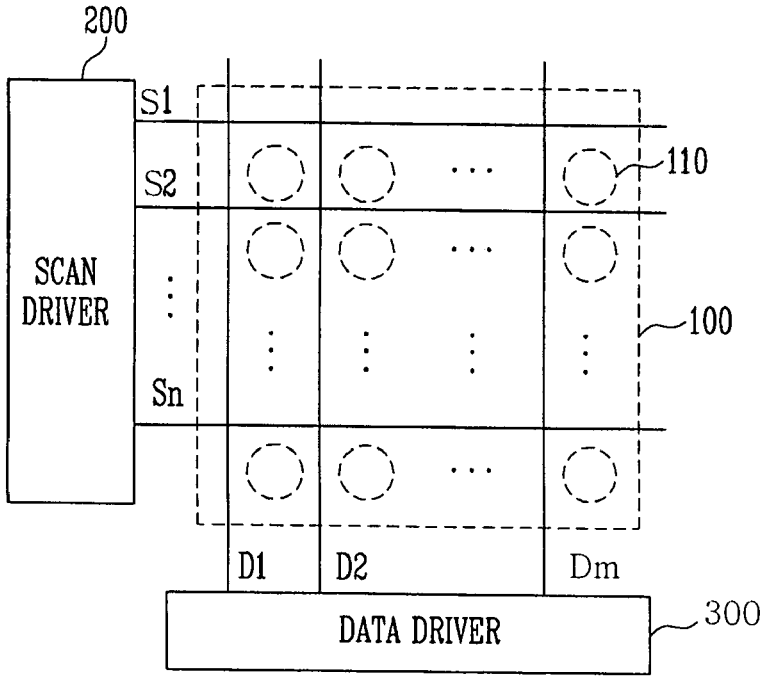
FIG. 3 RELATED ART
FIG. 3 illustrates a schematic view of an organic light emitting display panel including the OLED in FIG. 2.

Korean Patent Application No. 10-2006-0078063, filed on Aug. 18, 2006, in the Korean Intellectual Property Office, and entitled: "Organic Light Emitting Display," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Hereinafter, exemplary embodiments according to the present invention will be described with reference to the accompanying drawings. Here, when one element is connected to another element, one element may be not only directly connected to another element but also indirectly connected to another element via another element. Further, irrelative elements are omitted for clarity.

In accordance with the present invention, an organic light emitting display, including a pixel circuit operating by employing at least two different selection signals, may be driven in both directions. In particular, in accordance with an exemplary embodiment of the present invention, a forward signal for controlling a forward scan sequentially applying a selection signal in a forward direction and a reverse signal for controlling a reverse scan sequentially applying a selection signal in a reverse direction, may be used as the selection signals.

Figure 4:
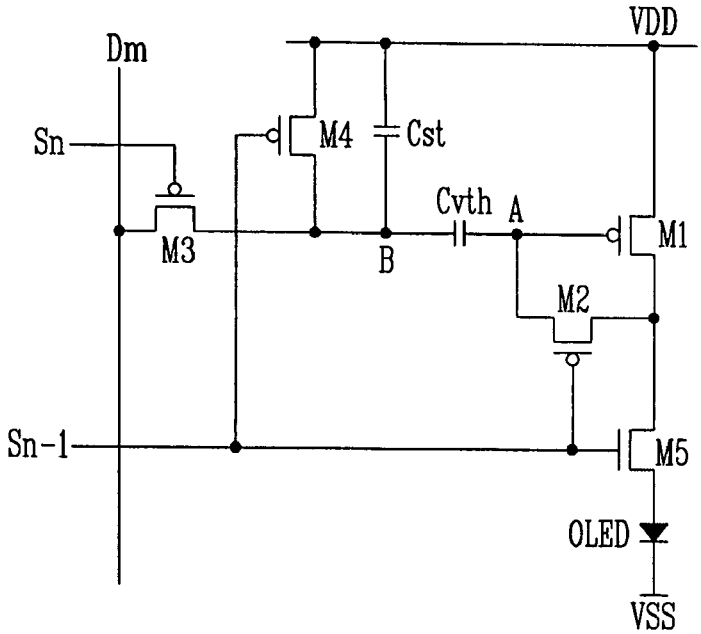
FIG. 4 illustrates an equivalent circuit diagram showing a pixel circuit according to an exemplary embodiment of the present invention.

FIG. 4 illustrates an equivalent circuit diagram of a pixel circuit according to an exemplary embodiment of the present invention. For convenience of description, FIG. 4 illustrates only a pixel circuit, which may be connected to an m-th data line Dm and an n-th scan line Sn. As used herein, the term "current scan line" means a scan line to transfer a current selection signal, and the term "previous scan line" means a scan line to transfer a selection signal prior to transferring the current selection signal.

As shown in FIG. 4, the pixel circuit may include transistors M1 to M5, capacitors Cvth and Cst, and an OLED. A first transistor M1 may drive the OLED. The first transistor M1 may be coupled between a power supply for supplying a voltage VDD to the OLED. The first transistor M1 may control an electric current flowing from the fifth transistor M5 to the OLED by a voltage applied to a gate thereto. The second transistor M2 may connect the first transistor M1 in response to a selection signal from a previous scan line Sn−1.

An electrode A of the first capacitor Cvth may be coupled to the gate of the first transistor M1. The second capacitor Cst may be connected in parallel between another electrode B of the first capacitor Cst and the power supply supplying the voltage VDD. The fourth transistor M4 may supply the voltage VDD from the power supply to the electrode B of the first capacitor Cvth in response to the selection signal from the previous scan line Sn−1.

The third transistor M3 may transfer data from the data line Dm to the electrode B of the first capacitor Cvth in response to a selection signal from the scan line Sn. The fifth transistor M5 may be coupled between a drain of the first transistor M1 and an anode of the OLED. The fifth transistor M5 may cut off a drain of the first transistor M1 and the OLED in response to the selection signal from the previous scan line Sn−1.

The OLED may emit light corresponding to an input electric current. A voltage VSS connected to a cathode of the OLED may have a level lower than that of the voltage VDD of the power supply. A ground voltage may be used as the voltage VSS.

Operation of the pixel circuit described above will now be explained.

First, when a low level scan voltage is applied to the previous scan line Sn−1, the third transistor M3 may be turned on, so that the first transistor M1 may be diode-connected. Accordingly, a voltage between a gate and a source of the first transistor M1 may vary to reach to a threshold voltage VTH of the first transistor M1. At this time, because a source of the first transistor M1 may be connected to the power supply voltage VDD, a voltage may be applied to a gate of the first transistor M1. Namely, the voltage at the first electrode A of the first capacitor Cvth may become a sum of the power supply voltage VDD and the threshold voltage VTH. Further, the fourth transistor M4 may be turned-on to apply the power supply voltage VDD to the second electrode B of the first capacitor Cvth, so that the first capacitor Cvth may be charged with a voltage VCvth expressed by equation 1:

$$VCvth=VCvthA-VCvthB=(VDD+VTH)-VDD=VTH \quad (1)$$

where VCvth represents a voltage charged in the first capacitor Cvth, VCvthA represents a voltage applied to the electrode A of the first capacitor Cvth, and VCvthB represents a voltage applied to the electrode B of the first capacitor Cvth.

Moreover, the second transistor M2 may have an N-type channel. The second transistor M2 may be cut off in response to a low level signal from the previous scan line Sn−1 to prevent an electric current flowing through the first transistor M1 to the OLED.

Next, when a low level scan voltage is applied to the current scan line Sn, the fifth transistor M5 may be turned-on to apply a data voltage VDATA to the electrode B of the first capacitor Cvth. Further, since the first capacitor Cvth has been charged with a voltage corresponding to the threshold voltage VTH of the first transistor M1, a voltage corresponding to a sum of the data voltage VDATA and the threshold voltage VTH of the first transistor M1 may be applied to the gate of the first transistor M1. That is, a voltage VGS between the gate and the source of the first transistor M1 may be expressed by equation 2:

$$VGS=(VDATA+VTH)-VDD \quad (2)$$

Furthermore, the second transistor M2 may be turned-on according to a high level of the current scan line Sn to supply an electric current to the OLED corresponding to a gate-source voltage of the first transistor M1 to the OLED, with the result that the OLED may emit light. Here, an electric current $I_{OLED}$ may be expressed by equation 3:

$$I_{OLED}=\frac{\beta}{2}(VGS-VTH)^2=\frac{\beta}{2}\{(VDATA+VTH-VDD)-VTH\}^2=\frac{\beta}{2}(VDD-VDATA)^2 \quad (3)$$

where, $I_{OLED}$ is the electric current flowing through the OLED, $V_{GS}$ is the voltage between the source and the gate of the first transistor M1, VTH is the threshold voltage of the first transistor M1, VDATA is the data voltage, and β is a constant.

While a scan signal is being applied to the previous scan line Sn−1, the second transistor M2 may be turned-off to prevent a leakage current from flowing and to express a substantially exact black gradation.

Up to now, an embodiment of the present invention has been described where five transistors and two capacitors may be included in the pixel circuit. The present invention is not limited to this configuration. The present invention may be applicable to all pixel circuits, which operate by at least two selection signals.

Figure 5:
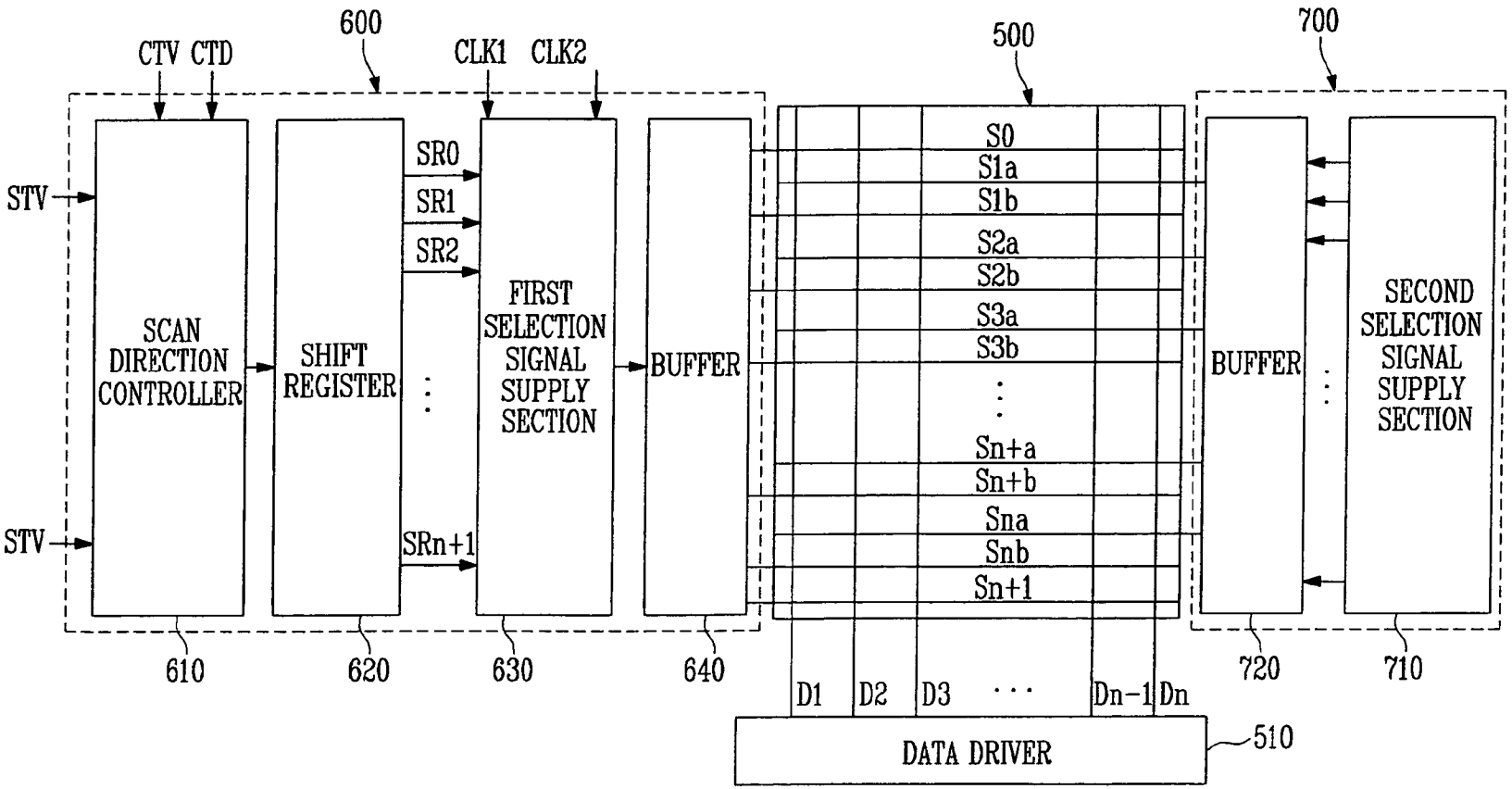
FIG. 5 illustrates a block diagram of an organic light emitting display according to an exemplary embodiment of the present invention.

FIG. 5 illustrates a block diagram of an organic light emitting display according to an exemplary embodiment of the present invention. Here, multiple pixel circuits included in a display panel of FIG. 5 may operate by at least two selection signals, as was described earlier with reference to FIG. 4.

With reference to FIG. 5, the organic light emitting display may include a display panel 500, a first scan driver 600, a second scan driver 700, and a data driver 510. The display panel 500 may display a normal screen or a screen rotated by about 180 degrees. N×M pixels (not shown) may be arranged on the display panel 500 in an array. Hereinafter, an unspecified pixel is referred to as "Pk," where, k is a natural number from 1 to n. The pixel circuit may be provided at an intersection of a pair of scan lines Ska and Skb and the data line Dm. One pixel Pk may be electrically connected to two scan lines Ska and Skb to which different selection signals are applied. In this case, in one pixel Pk, passive elements operating by the same selection signal may be connected to the same scan line. For example, for k=1, pixel P1 may be provided at an intersection of scan lines S1*a* and S1*b*.

In the pixel circuit Pk, the scan line Ska may be electrically connected to the second transistor M2, the fourth transistor M4, and the fifth transistor M5, and may function as a previous scan line. The scan line Skb may be electrically connected to the third transistor M3, and may function as a current scan line. Accordingly, the number of scan lines S1*a*, S1*b*, S2*a* . . . Sna, and Snb present at the display panel 500 may become twice the total number of pixels.

As illustrated earlier, the data driver 510 may include a bi-directional shift register, which may result in a bi-directional data driver capable of applying a data signal in both directions. Furthermore, the first and second scan drivers 600 and 700 may be provided at both sides of the display panel 500. The first scan driver 600 may include a scan direction controller 610, a shift register 620, a first selection signal supply section 630, and a buffer section 640. The second scan driver 700 may include a second selection signal supply section 710 and a buffer section 720.

The first scan driver 600 may function to provide a selection signal to the first scan line, namely, the current scan line Skb in the pixel circuit included in the display panel 500. The second scan driver 700 may function to provide a selection signal to the second scan line, namely, the previous scan line Ska in the pixel circuit included in the display panel 500.

Moreover, the first and second scan drivers 600 and 700 may form a bi-directional scan drive. During a forward scan drive, the first and second scan drivers 600 and 700 may sequentially apply a selection signal to scan lines S1*a*, S1*b*, S2*a* . . . Sna, and Snb in a lower direction. In contrast, during a reverse scan drive, the first and second scan drivers 600 and 700 may sequentially apply the selection signal to scan lines Sna, Snb, S2*a* . . . Sn−1a . . . Sn−1b, S1*a*, S1*b* in an upper direction.

The scan direction controller 610 may control the first scan driver 600 to perform a forward or reverse scan drive. When the scan direction controller 610 receives a forward signal CTV or a reverse signal CTD, it may cause the shift register 620 connected to a next stage to generate sequential signals in a forward or a reverse direction.

Figure 6:
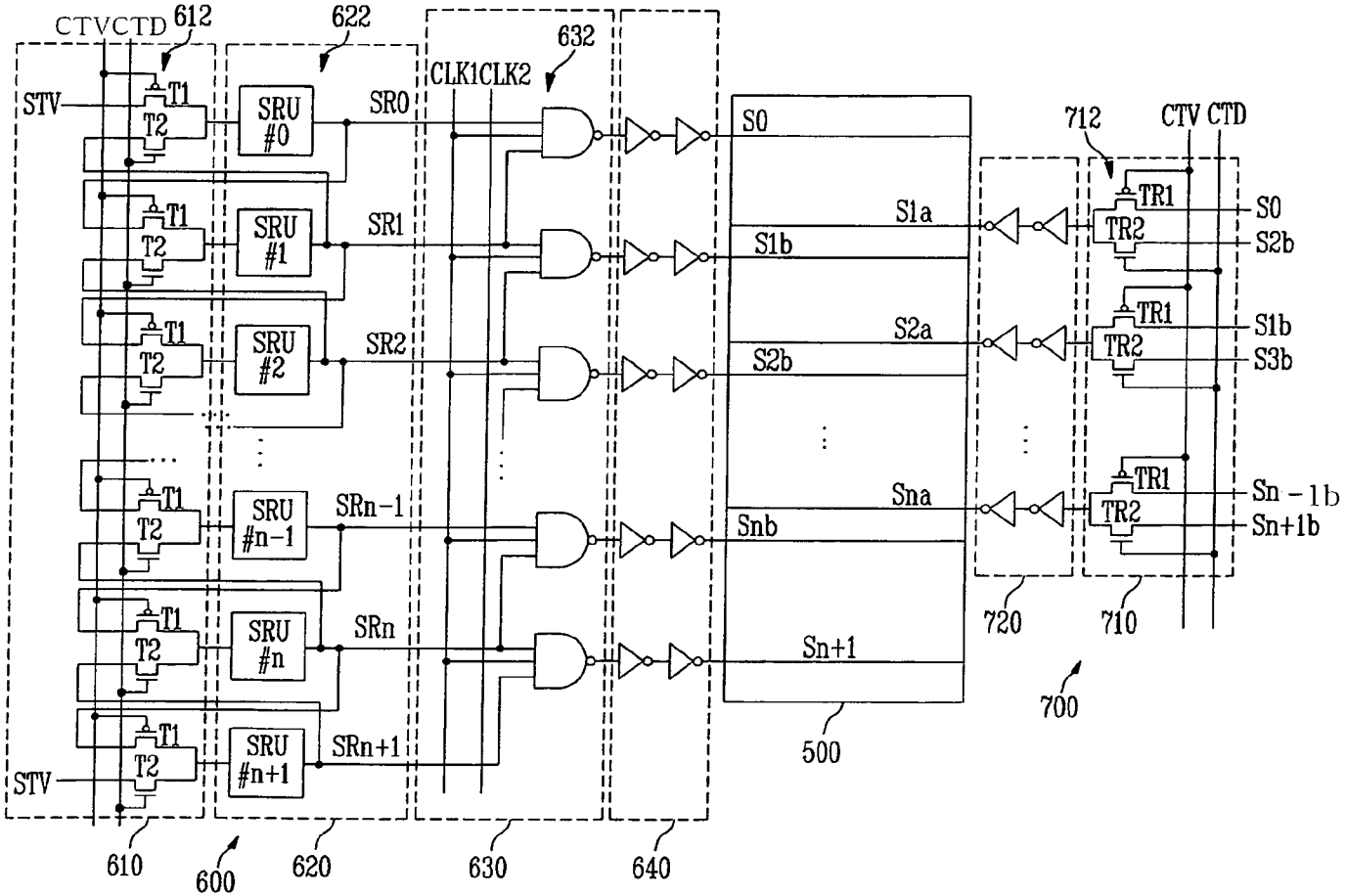
FIG. 6 illustrates a detailed view of a construction of first and second scan drivers shown in FIG. 5.

That is, when the scan direction controller 610 receives the forward signal CTV, an initial start signal STV may be transferred to a zero-th unit SRU#0 of the shift register 620, where it may cause the shift register 620 to generate sequential signals SR0, SR1, SR2 . . . SRn+1 in the forward direction. In contrast, when the scan direction controller 610 receives the reverse signal CTD, the initial start signal STV may be transferred to an n+1-th unit SRU#n+1 of the shift register 620, where it may cause the shift register 620 to generate sequential signals SRn+1, SRn, SRn−1 . . . SR0 in the reverse direction. The units of the shift register 620 are illustrated in FIG. 6.

Furthermore, the shift register 620 may be a bi-directional shift register, which may perform a bi-directional scan. The shift register 620 may include units 622, which may be n+2 units SRU#0, SRU#1 . . . SRU#n+1, shown in FIG. 6. Under control of the scan direction controller 610, the shift register 620 may shift the initial start signal STV in the forward or reverse direction to generate sequential signals.

The first selection signal supply section 630 may be composed of multiple three terminal NAND gates 632, which may receive one of two adjacent signals from the shift register 620, and first and second clock signals CLK1 and CLK2. The first selection signal supply section 630 provides selection signals to the current scan lines Skb of the pixel circuits in the display panel 500 through the NAND gates 632. In order to stabilize the selection signals output to the display panel 500, a buffer section 640 may be further provided between the first selection signal supply section 630 and the display panel 500.

That is, during a forward scan drive, the first selection signal supply section 630 may sequentially apply a selection signal to current scan lines S1*b*, S2*b* . . . Snb of the scan lines in the lower direction. In contrast, during a reverse scan drive, the first selection signal supply section 630 may sequentially apply the selection signal to current scan lines Snb, Sn−1 . . . S1*b* of the scan lines in the upper direction.

As described above, when one of the forward signal CTV and the reverse signal CTD is applied to the second selection signal supply section 710, it may provide the selection signal to the previous scan line Skb of the pixel circuit included in the display panel 500 in the forward or reverse direction.

Here, the selection signal provided by the second selection signal supply section 710 may be a selectively output signal among signals received from the first scan driver 600 according to the forward or reverse signal. For stabilization of the selection signal output to the display panel 500, the buffer section 720 may be further provided between the second selection signal supply section 710 and the display panel 500.

During the forward scan drive, the second selection signal supply section 710 may sequentially apply the selection signal to previous scan lines S1*a*, S2*a* . . . Sna of scan lines in the lower direction. In contrast, during the reverse scan drive, the second selection signal supply section 710 may sequentially apply the selection signal to previous scan lines Snb, Sn−1b . . . S1*b* of the scan lines in the upper direction.

Here, the selection signal provided by the second selection signal supply section 710 may be a selectively output signal among signals received from the first selection signal supply section 610 according to the forward or reverse signal. For example, during the forward scan drive, the selection signal output to the previous scan line S1*a* from the second scan driver 700 may be identical to the selection signal output to a scan line S0 from the first scan driver 600. Further, the selection signal output to the previous scan line S2*a* from the second scan driver 700 may be substantially identical to the selection signal output to the previous scan line S1*b* from the first scan driver 600.

In the same manner, during the reverse scan drive, the selection signal output to the previous scan line Sna from the second scan driver 700 may be substantially identical to the selection signal output to a scan line Sn+1 from the first scan driver 600. Further, the selection signal output to the previous scan line Sn−1a from the second scan driver 700 may be substantially identical to the selection signal output to the previous scan line Snb from the first scan driver 600.

As explained previously, the first and second scan drivers 600 and 700 may apply respective selection signals to corresponding scan lines S1*a*, S1*b*, S2*a*, S2*b* . . . Sna, Snb in response to the forward signal CTV and the reverse signal CTD.

Namely, when the forward signal CTV is applied, the selection signals from the second scan driver 700 may be sequentially applied to previous scan lines ("a" scan lines) S1*a*, S2*a*, S3*a*, S4*a* . . . Sna in the lower direction, whereas the selection signals from the first scan driver 700 may be sequentially applied to current scan lines ("b" scan line) S1*b*, S2*b*, S3*b*, S4*b* . . . Snb in the upper direction.

Here, the selection signals output to previous scan lines S1*a*, S2*a*, S3*a*, S4*a* . . . Sna from the second scan driver 700 may be substantially identical with the selection signals output to the current scan lines S1*b*, S2*b*, S3*b*, S4*b* . . . Snb from the first scan driver 600, respectively.

According to an embodiment of the present invention, in a panel including passive elements M2, M4, and M5 in one pixel operating by the previous selection signal connected to the "a" scan lines, and the passive element M3 operating by a current selection signal connected to the "b" scan lines, the previous selection signal may be applied to the "a" scan lines in the case of the forward or reverse scan, and the current selection signal may be applied to the "b" scan lines, so that a normal image may be displayed.

FIG. 6 illustrates a detailed view of the first and second scan drivers illustrated in FIG. 5.

Referring to FIG. 6, the scan direction controller 610 may include n+2 control units 612. Each of the control units 612 may include a first transistor T1 and a second transistor T2. The first transistors T1 may be turned-on according to the forward signal CTV, and may provide a start signal STV or an output signal of a shift register unit in a previous stage to a shift register unit. The second transistors T2 may be turned-on according to the reverse signal CTD, and may provide a start signal STV or an output signal of a shift register unit in a previous stage.

Namely, as shown in FIG. 6, when the forward signal CTV is applied to a gate of the first transistor T1 of a zero-th control unit of the control units 612, the first transistor T1 may be turned-on to transfer the start signal STV applied to a source thereto to the zero-th shift register unit SRU#0. When the reverse signal CTD is applied to a gate of the second transistor T2 of the zero-th control unit, the second transistor T2 may be turned-on to transfer an output signal of a shift register unit of a next stage, e.g., a first shift register unit SRU#1 may be a source to the zero-th shift register unit SRU#0.

Furthermore, when the forward signal CTV is applied to gates of first transistors T1 of first to n-th control units, the first transistors T1 may be turned-on to transfer output signals of shift register units SRU#0 . . . SRU#n−1 of the previous stage applied to a source thereto to first to n-th shift registers SRU#1 . . . SRU#n. When the reverse signal CTD is applied to gates of second transistors T2 of the first to n-th control units, the second transistors may be turned-on to transfer output signals of shift register units SRU#2 . . . SRU#n+1 of the next stage applied to a source thereto to first to n-th shift registers SRU#1 . . . SRU#n.

Moreover, when the forward signal CTV is applied to a gate of the first transistor T1 of an n−1-th control unit, the first transistor T1 may be turned-on to transfer an output signal of the shift register unit in the previous stage, namely a n-th shift register SRU#n applied to a source of an n+1-th shift register SRU#n+1. When the reverse signal CTD is applied to a gate of the second transistor T2 of an n+1-th control unit, the second transistor T2 may be turned-on to transfer the start signal STV applied to the source of the n+1-th shift register SRU#n+1.

Here, the respective control units 612 constituting the scan direction controller 610 are not limited to the arrangement shown in FIG. 6. For example, the respective control units 612 may be formed by transmission gates.

The shift register 620 may be a bi-directional shift register having a bi-directional scan function. The shift register 620 may include n+2 units 622, which may include units SRU0, SRU1 . . . SRUn+1. Under control of the scan direction controller 610, the shift register 620 may shift the start signal STV in the forward or reverse direction to generate sequential signals SR0, SR1 . . . SRn+1 or SRn+1, SRn, SRn−1 . . . SR0.

In addition, the first selection signal supply section 630 may include n+1 three terminal NAND gates 632, which may receive one of two adjacent signals from the shift register 620, and first and second clock signals CLK1 and CLK2. The first selection signal supply section 630 may provide a selection signal to a current scan line Skb of the pixel circuit in the display panel 500 through the NAND gates. In order to stabilize the selection signal output to the display panel 500, the buffer section 640 may be further provided between the first selection signal supply section 630 and the display panel 500.

That is, a zero-th NAND gate of the first selection signal supply section 630 may receive and perform a NAND operation on the output signal SR0 of the zero-th shift register unit SRU#0, an output signal of a first shift register unit, and the first clock signal CLK1, and outputs the selection signal to the S0 scan line.

Moreover, first to n−1 NAND gates of the first selection signal supply section 630 may receive and NAND output signals SR1, SR2 . . . SRn−1, SRn of the shift register 620 and the first clock signal CLK1 or second clock signal CLK2, and may output the selection signal to scan lines S1*b*, S2*b* . . . Snb.

Furthermore, a n-th NAND gate of the first selection signal supply section 630 may receive and perform a NAND operation on the output signal SRn of a n-th shift register unit, the output signal SRn+1 of the n+1-th shift register, and the first clock signal CLK1, and may output the selection signal to the Sn+1 scan line. Here, the S0 and Sn+1 scan lines may be dummy scan lines, and a pixel connected thereto may not emit light.

In addition, during the forward scan drive, the first selection signal supply section 630 may sequentially apply the selection signal to previous scan lines S1*b*, S2*b* . . . Snb in the lower direction, which may be connected to respective pixel circuits of the display panel 500. In contrast, during the reverse scan drive, the first selection signal supply section 610 may sequentially apply the selection signal to previous scan lines Snb, Sn−1b . . . S1*b* of the scan lines in the upper direction, which may be connected to respective pixel circuits of the display panel 500.

A waveform of a final output signal through the NAND operations of output signals SR0, SR1 . . . SRn+1, and the first and second clock signals will be now explained with reference to the timing charts of FIG. 8 and FIG. 10, which illustrate the forward or reverse drive.

The second selection signal supply section 710 of the second scan driver 700 may be composed of n selection units 712. Each of the n selection units 712 may include a first transistor TR1 and a second transistor TR2. The first transistor TR1 may be turned-on according to the forward signal CTV and may provide an output signal of a NAND gate of a previous stage of the first selection signal supply section 630 as the selection signal of the display panel. The second transistor TR2 may be turned-on according to the reverse signal CTD and may provide an output signal of a NAND gate of a next stage of the first selection signal supply section 630 as the selection signal of the display panel 500.

As shown in FIG. 6, when the forward signal CTV is applied to gates of the first transistors TR1 of first to n selection units 712, the first transistors TR1 may be turned-on to provide output signals S0, S1*b* . . . Sn−1b of NAND gates of the previous stage, namely, zero to n−1 NAND gates, applied to a source thereto as the selection signal of the display panel 500. When the reverse signal CTD is applied to gates of the second transistors TR2 of first to n-th selection units 712, the second transistors TR2 may be turned-on to provide output signals S2*b*, S3*b* . . . Sn+1b of NAND gates of the next stage, namely, second to n+1 NAND gates applied to a source thereto, as the selection signal of the display panel 500.

Here, the respective selection units 712 constituting the second selection signal supply section 710 are not limited to an arrangement shown in FIG. 6. For example, the respective selection units 712 may be embodied by transmission gates.

As any one of the forward signal CTV and the reverse signal CTD may be applied to the second selection signal supply section 710, it may provide the selection signal to a previous scan line Skb of a pixel circuit in the display panel 500 in the forward or reverse direction.

Here, the selection signal provided by the second selection signal supply section 710 may be a selectively output signal among signals received from the first scan driver 600 (or the first selection signal supply section 630) according to the forward or reverse signal. In order to stabilize the selection signal output to the display panel 500, the buffer section 720 may be further provided between the second selection signal supply section 710 and the display panel 500.

That is, during the forward scan drive, the second selection signal supply section 710 may sequentially apply the selection signal to previous scan lines S1*a*, S2*a* . . . Sna in the lower direction, which may be connected to the respective pixel circuits of the display panel 500. In contrast, during the reverse scan drive, the second selection signal supply section 710 may sequentially apply the selection signal to previous scan lines Snb, Sn−1b . . . S1*b* in the upper direction, which may be connected to the respective pixel circuits of the display panel 500.

Here, as described earlier, the selection signal provided by the second selection signal supply section 710 may be a selectively output signal among signals received from the first selection signal supply section 630 according to the forward or reverse signal. For example, during the forward drive, the selection signal output to the S1*a* scan line from the second scan driver 700 may be substantially identical with the selection signal output to the S0 scan line from the first scan driver 600. Further, the selection signal output to the S2*a* scan line from the second scan driver 700 may be substantially identical with the selection signal output to the S1*b* scan line from the first scan driver 600.

In a similar manner, during the reverse drive, the selection signal output to the Sna scan line from the second scan driver 700 may be substantially identical with the selection signal output to the Sn+1 scan line from the first scan driver 600. Further, the selection signal output to the Sn−1a scan line from the second scan driver 700 may be substantially identical with the selection signal output to the Snb scan line from the first scan driver 600.

Figure 7:
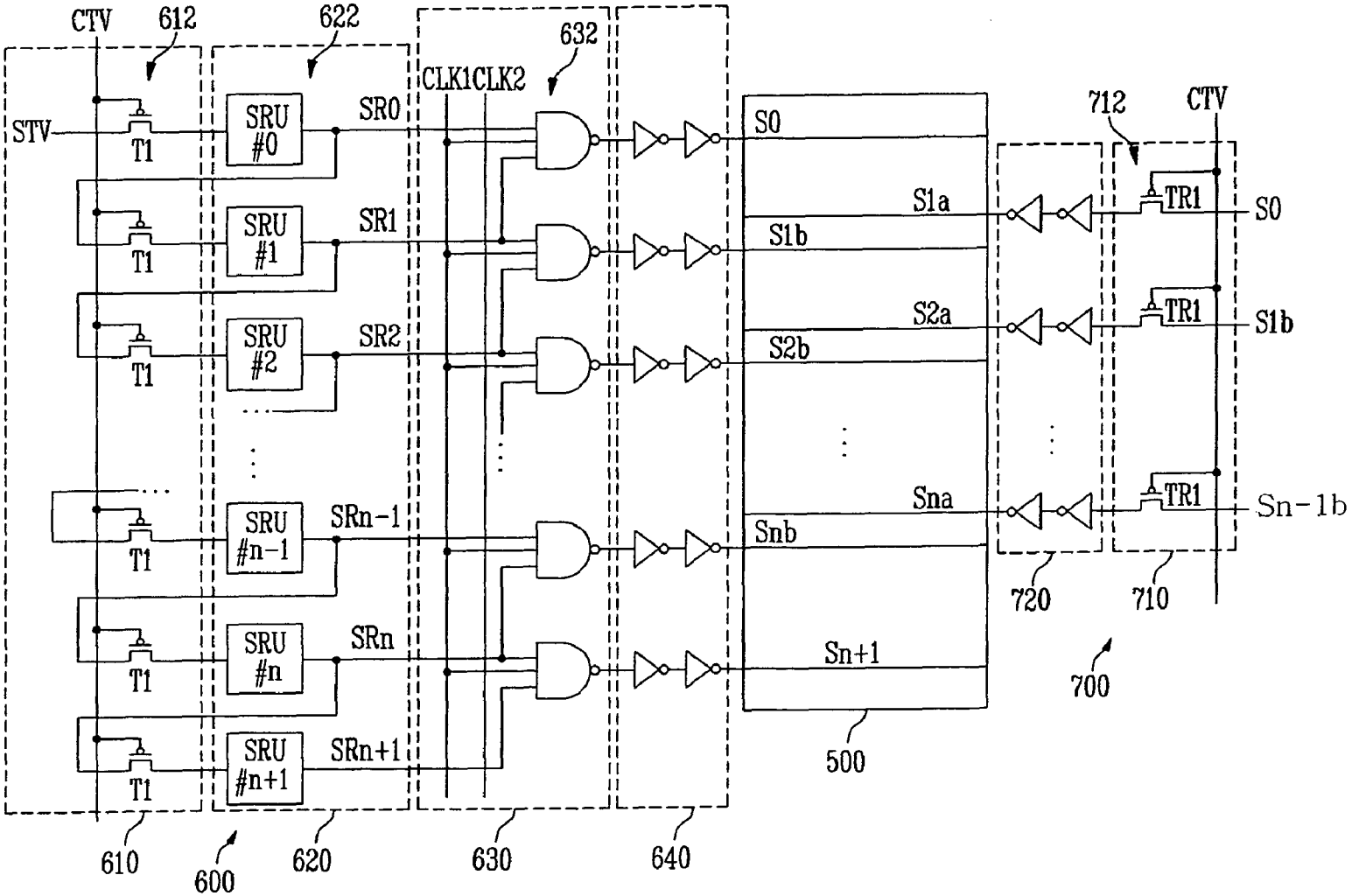
FIG. 7 illustrates a view of a forward driving operation of the first and second scan drivers shown in FIG. 6.
Figure 8:
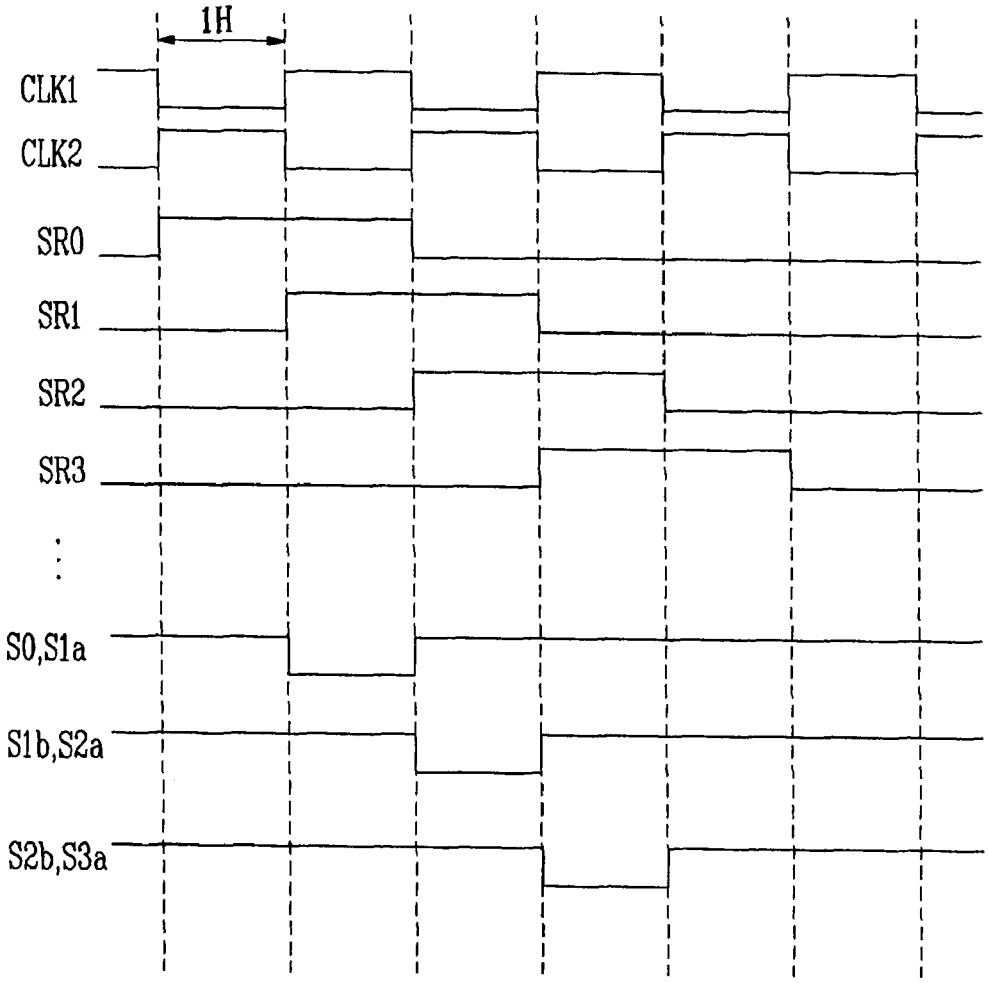
FIG. 8 illustrates a timing chart of the forward driving operation of the first and second scan drivers shown in FIG. 6.

FIG. 7 illustrates a view of the forward driving operation of the first and second scan drivers shown in FIG. 6. FIG. 8 illustrates a timing chart of the forward driving operation of the first and second scan drivers shown in FIG. 6.

With reference to FIG. 7 and FIG. 8, when the low level forward signal CTV is applied to scan direction controller 610 of the first scan driver 600, first transistors T1 of control unit 612 in the scan direction controller 610 may be turned-on. The first transistors T1 may be P-channel transistors.

On the other hand, the low level reverse signal CTD may be applied to the scan direction controller 610 of the first scan driver 600. In this case, second transistors T2 of the control units 612 may be turned-off. The second transistors T2 may be N-channel transistors. In other words, although the forward signal CTV and the reverse signal CTD may be separately applied, they may alternately be applied as the same signal.

Accordingly, when the first transistors T1 of the control units 612 are turned-on, the initial start signal STV may be provided to the zero-th shift register unit SRU#0 through the zero-th control unit, and the shifted signal SR0 thereof may be output. The shifted signal SR0 may be provided to the first shift register SRU#1 through the first control unit, so that it outputs the signal SR1 shifted by about one horizontal period 1H.

Namely, as the forward low level signal CTV may be applied to the scan direction controller 610 of the first scan driver 600, a start signal may be applied to the zero-th shift register SRU#0 through the zero-th control unit to output the SR0 signal. The SR0 signal may be applied to the shift register unit of the next stage, namely, the first shift register unit SRU#1 through the control unit of the next stage, namely, a first control unit to output the SR1 signal.

As a result, as shown in FIG. 8, SR0, SR1, SR2, SR3 . . . signals may be sequentially generated in the lower direction of the display panel 500 through the scan direction controller 610 and the shift register 620.

Accordingly, one of two adjacent signals and first and second clock signals CLK1 and CLK2 from the shift register 620 may be input to n+1 three terminal NAND gates 632 included in the first selection signal supply section 630.

Here, the first and second clock signals CLK1 and CLK2 may have a time period of about 1H, and the phases thereof may be inverted and input.

That is, a zero-th NAND gate may receive and perform a NAND operation on the output signal SR0 of the zero-th shift register unit SRU#0, the output signal SR1 of the first shift register unit SRU#1, and the first clock signal CLK1, and may output the selection signal to the S0 scan line.

With reference to FIG. 8, the selection signal output from the S0 scan line may become a low level signal by a NAND operation of the first high level clock signal CLK1, the high level SR0 signal, and the high level S1 signal.

Moreover, first to n−1 NAND gates may receive one of SR1, SR2 to SRn−1, SRn, along with the first clock signal CLK1 or the second clock signal CLK2, and may output the selection signal to S1*b* to Snb scan lines.

Namely, as shown in FIG. 8, the selection signal output to the S1*b* scan line may have a low level by a NAND operation of the second high level clock signal CLK2, and SR1 and SR2 of a high level. The selection signal output to the S2*b* scan line may have a low level signal resulting from a NAND operation of the high level first clock CLK1, and SR2 and SR3 of a high level.

The generated selection signals may be finally provided to the current scan line Skb of the pixel circuit included in the display panel 500 as the selection signal. Here, the S0 and Sn+1 scan lines may be dummy scan lines, and any pixel connected thereto may not emit light.

That is, during the forward scan drive, the first selection signal supply section 630 may sequentially apply the selection signal to previous scan lines S1*b*, S2*b* . . . Snb in the lower direction, which may be connected to the respective pixel circuits of the display panel 500.

When the low level forward signal CTV is applied to the first transistor TR1 of the selection units 712, it may be turned-on. The first transistors TR1 may be P-channel transistors.

On the other hand, the low level reverse signal CTD may be applied. In this case, the second transistors TR2 of the selection units 712 may be N-channel transistors, and may be all turned-off. In other words, although the forward signal CTV and the reverse signal CTD have been illustrated as being separately applied, they may also be applied as the same signal.

Accordingly, in the selection units 712, each first transistor TR1 may be turned-on to provide an output signal of the NAND gate in a previous stage as the selection signal of the display panel 500. The NAND gates may be included in the first selection signal supply section 612 of the first scan driver 600.

Namely, as shown in FIG. 7, when the forward signal CTV is applied to the gates of first transistors TR1 of first to n selection units 712, the first transistors TR1 may be turned-on according to the forward signal CTV to provide output signals S0, S1*b*, . . . , Sn−1b of NAND gates of the previous stage, namely, zero to n−1 NAND gates applied as a source of the selection signal of the display panel 500.

Accordingly, during the forward drive, the second selection signal supply section 710 may sequentially apply a selection signal to previous scan lines S1*a*, S2*a* . . . Sna of the scan lines in the lower direction, which may be connected to the respective pixel circuits of the display panel 500.

Here, the selection signal provided by the second selection signal supply section 710 may be a selectively output signal among signals received from the first selection signal supply section 630 according to the forward or reverse signal. As shown in FIG. 8, in the case of the forward drive, the selection signal output to the S1*a* scan line from the second scan driver 700 may be substantially identical with the selection signal output to the S0 scan line from the first scan driver 600. Further, the selection signal output to the S2*a* scan line from the second scan driver 700 may be substantially identical with the selection signal output to the S1*b* scan line from the first scan driver 600.

As a result, in the display panel 500 including passive elements M2, M4, and M5 in one pixel operating by the previous selection signal connected to the "a" scan lines, and the passive element M3 operating by the current selection signal connected to the "b" scan lines, the previous selection signal may be applied to the "a" scan lines, and the current selection signal may be applied to the "b" scan lines during the forward scan, so that a normal image may be displayed.

Figure 9:
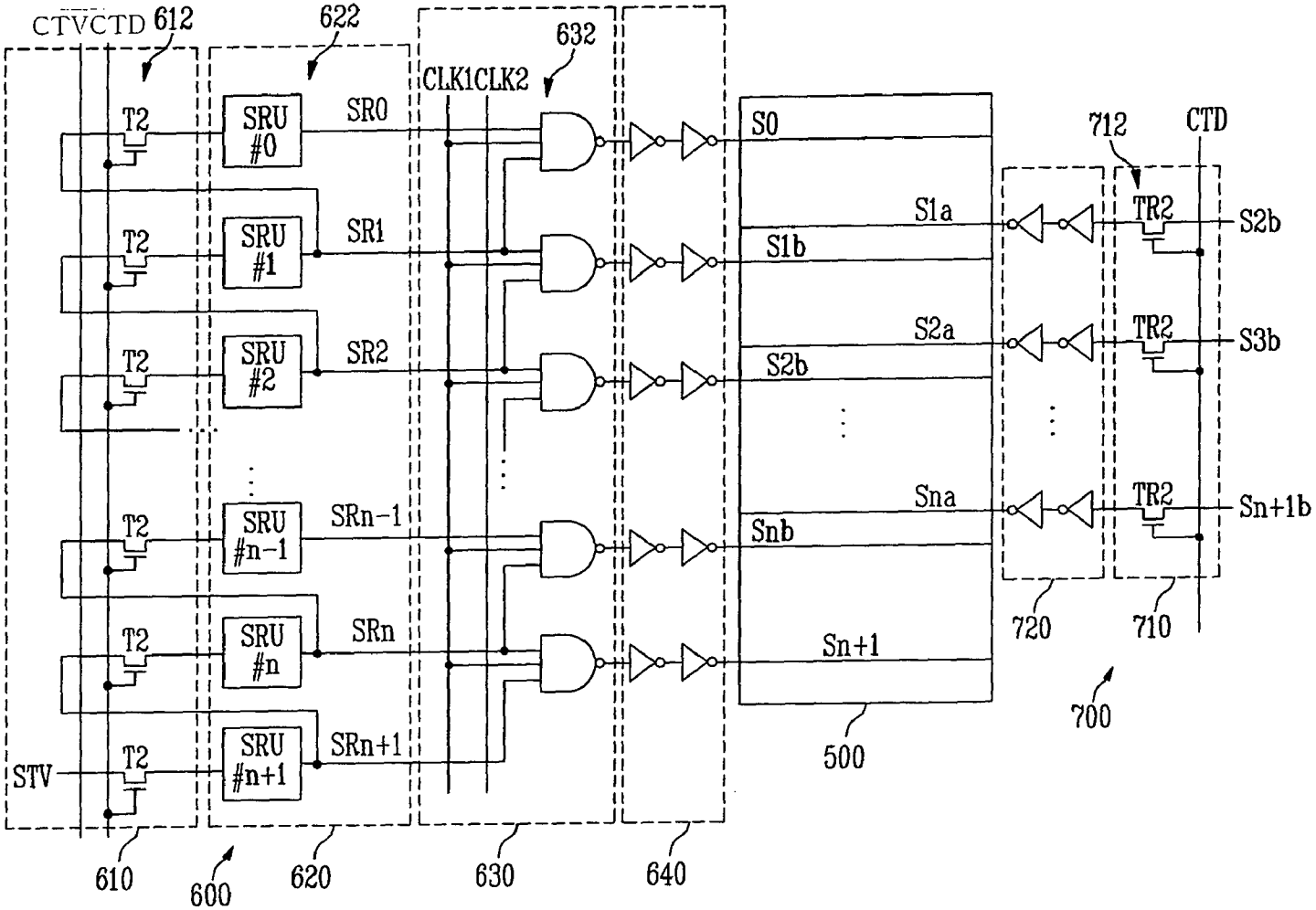
FIG. 9 illustrates a view of a reverse driving operation of the first and second scan drivers shown in FIG. 6.
Figure 10:
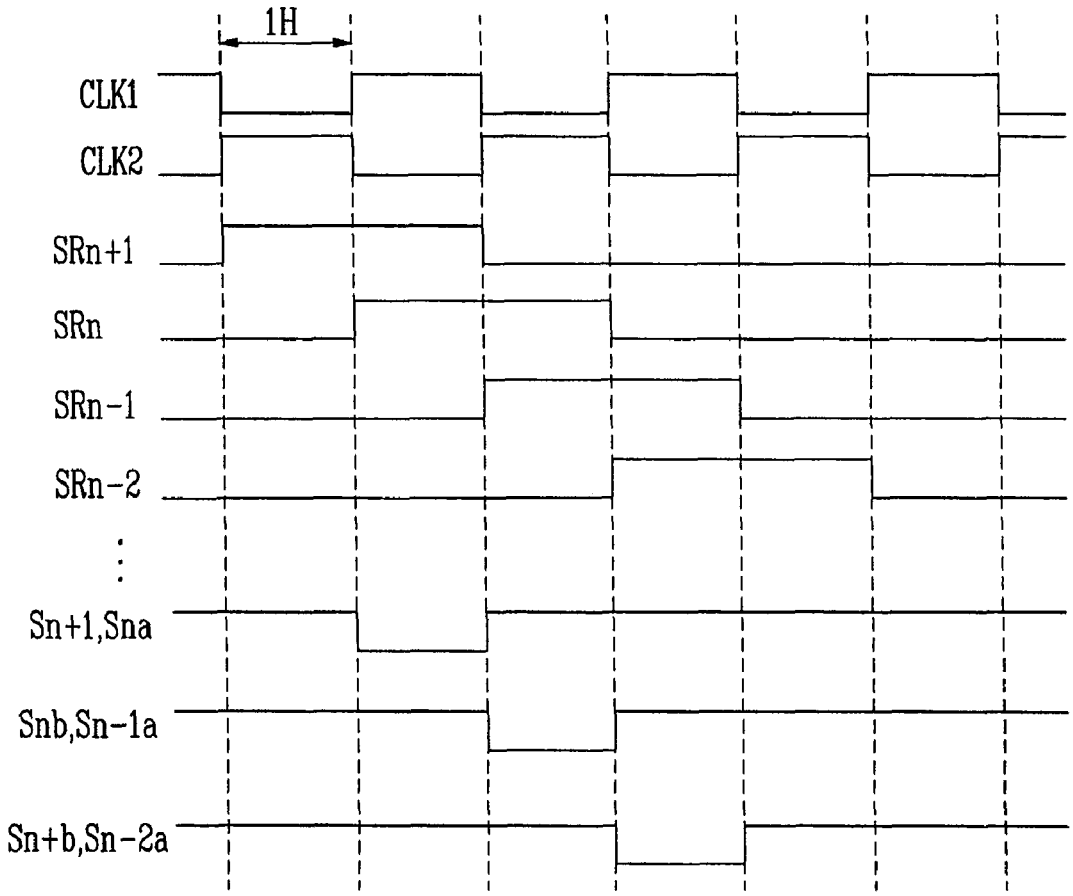
FIG. 10 illustrates a timing chart of the reverse driving operation of the first and second scan drivers shown in FIG. 6.

FIG. 9 illustrates a view of a reverse driving operation of the first and second scan drivers shown in FIG. 6. FIG. 10 illustrates a timing chart of the reverse driving operation of the first and second scan drivers shown in FIG. 6.

With reference to FIG. 9 and FIG. 10, when the high level reverse signal CTD is applied to the scan direction controller 610 of the first scan driver 600, the second transistor T2 of each of the control units 612 included in the scan direction controller 610 may be turned-on. Here, the second transistors T2 may be N-channel transistors.

On the other hand, the low level reverse signal CTD may be applied. In this case, the first transistors T1 may be P-channel transistors, and may be all turned-off.

Accordingly, as the first transistors T1 of the control unit 612 may be turned-on, the initial start signal STV may be provided to the n+1 th shift register unit SRU#n+1 through the n+1 th control unit and the shifted signal SRn+1 thereof may be output. The shifted signal SRn+1 may be provided to the n-th shift register SRU#n through the n-th control unit, so that it may output the signal SRn shifted by about 1 horizontal period 1H.

That is, when applying the high level reverse signal CTD, the initial start signal STV may be provided to the n+1 th shift register unit SRU#n+1 through the n+1-th control unit to output the SRn+1 signal. The SRn+1 signal may be applied to the shift register unit, namely, the n-th shift register unit SRU#n through the control unit of the previous stage, namely, the n-th control unit to output the SRn signal.

As a result, as illustrated in FIG. 10, SRn+1, SRn, SRn−1, SRn−2 . . . signals may be sequentially generated through the scan direction controller 610 and the shift register 620. Accordingly, one of two adjacent signals and first and second clock signals CLK1 and CLK2 from the shift register 620 may be input to the n+1 three terminal NAND gates 632 included in the first selection signal supply section 630. Here, the first and second clock signals CLK1 and CLK2 may have a time period of 1H, and the phases thereof may be inverted and input. That is, the n+1-th NAND gate may receive and perform a NAND operation on the output signal SRn+1 of the n+1-th shift register unit, the output signal SRn of the n-th shift register, and the first clock signal CLK1, and may output the selection signal to the Sn+1 scan line.

With reference to FIG. 10, the selection signal output from the Sn+1 scan line may have a low level signal resulting from a NAND operation of the first high level clock signal CLK1, the high level SRn+1 signal, and the high level SRn signal. Moreover, the first to n NAND gates may receive one of SRn, SRn−1 to SR1, SR0, and the first clock signal CLK1 or the second clock signal CLK2, and may output a selection signal to the Snb to S1*b* scan lines.

Namely, as shown in FIG. 10, the selection signal output to the Snb scan line may have a low level signal resulting from a NAND operation of the second high level clock signal CLK2, and high level SRn and SRn−1. The selection signal output to the Sn−1b scan line may have a low level signal resulting from a NAND operation of the high level first clock signal CLK1, and high level SR2 and SR3.

The generated selection signals may be finally provided to the current scan line Skb of the pixel circuits included in the display panel 500. Here, the Sn+1 and S0 scan lines may be dummy scan lines, and any pixel connected thereto may not emit light.

That is, during the reverse scan drive, the first selection signal supply section 630 may sequentially apply the selection signal to current scan lines Snb, Sn−1b . . . S1*b* of scan lines in the lower direction, which may be connected to the respective pixel circuits of the display panel 500.

When the high level reverse signal CTD is applied to the second transistor TR2 of the selection unit 712, it may be turned-on. The second transistors TR2 may be N-channel transistors. On the other hand, the high level forward signal CTV may be applied. In this case, the second transistors TR2 of the selection unit 712 may be formed of P-channel transistors, and may be all turned-off.

In other words, although the forward signal CTV and the reverse signal CTD have been described as being separately applied, they may also be applied as the same signal.

Accordingly, in the selection units 712, each second transistor TR2 may be turned-on according to the reverse signal CTD to provide the output signal of the NAND gate in the previous stage as the selection signal of the display panel 500. Here, the NAND gates may be included in the first selection signal supply section 630 of the first scan driver 600.

Namely, as shown in FIG. 9, when the reverse signal CTD is applied to the gates of second transistors TR2 of the first to n selection units 712, the second transistors TR2 may be turned-on to provide output signals S2*b*, S3*b* . . . Sn+1 of the NAND gates of the previous stage, namely, second to n+1 NAND gates applied as a source of the selection signal of the display panel 500.

Accordingly, during reverse driving, the second selection signal supply section 710 may sequentially apply the selection signal to previous scan lines Sna, Sn−1a . . . S1*a* in the upper direction, which may be connected to respective pixel circuits of the display panel 500.

Here, the selection signal provided by the second selection signal supply section 710 may be a selectively output signal among signals received from the first selection signal supply section 630 according to the forward or reverse signal. As shown in FIG. 10, when in forward drive, the selection signal output to the Sna scan line from the second scan driver 700 may be substantially identical with the selection signal output to the Sn+1 scan line from the first scan driver 600. Further, the selection signal output to the Sn−1a scan line from the second scan driver 700 may be substantially identical to the selection signal output to the Snb scan line from the first scan driver 600.

As a result, in the panel 500 including passive elements M2, M4, and M5 in one pixel operating by the previous selection signal connected to the "a" scan lines, and the passive element M3 operating by the current selection signal connected to the "b" scan lines, the previous selection signal may be applied to the "a" scan lines, and the current selection signal may be applied to the "b" scan lines during the forward scan, so that a normal image may be displayed.

The driving technology of the present invention has been described as being applied to OLEDS. However, the present invention is not restricted to OLEDS, and the driving technology may be applied to any appropriate display.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a display panel including a plurality of pixel circuits, a data line, and first and second scan lines;

a bi-directional data driver adapted to apply a data signal in both directions;

a first scan driver adapted to receive a forward or reverse signal and to selectively output a first selection signal in a forward or reverse direction to the first scan line in accordance with the forward or reverse signal, wherein the first scan driver includes:

a scan direction controller adapted to receive the forward or reverse signal, and to cause a shift register of a next stage to generate a sequential signal in the forward or reverse direction, a shift register adapted to shift a start signal received by the scan direction controller to generate the sequential signal, a first selection signal supply section adapted to receive one of two adjacent signals, and first and second clock signals from the shift register and to provide the first selection signal to the first scan line; and a second scan driver adapted to receive the first selection signal and to selectively output a second selection signal in the forward or reverse direction to the second scan line in accordance with the forward or reverse signal.

2. The organic light emitting display as claimed in claim 1, wherein the first and second scan drivers are at both sides of the display panel, respectively.

3. The organic light emitting display as claimed in claim 1, further comprising:

a buffer section between the first selection signal supply section and the display panel.

4. The organic light emitting display as claimed in claim 1, wherein the scan direction controller includes a plurality of control units, each control unit having a first transistor adapted to be turned-on according to the forward signal to provide the start signal or an output signal of a shift register in a previous stage to a shift register unit, and a second transistor adapted to be turned-on according to the reverse signal to provide the start signal or an output signal of a shift register unit in a next stage to the shift register unit.

5. The organic light emitting display as claimed in claim 4, wherein the first and second transistors are different types from each other.

6. The organic light emitting display as claimed in claim 1, wherein the first selection signal supply section includes a plurality of three terminal NAND gates, which are adapted to receive one of two adjacent signals, and first and second clock signals from the shift register.

7. The organic light emitting display as claimed in claim 1, wherein the first and second clock signals have a time period of 1H, and the phases thereof are inverted and input.

8. The organic light emitting display as claimed in claim 1, wherein the second scan driver includes a second signal selection supply section, which outputs a first previous selection signal of the first scan driver as a second selection signal in response to the forward signal, and outputs a first next selection signal of the first scan driver as the second selection signal in response to the reverse signal.

9. The organic light emitting display as claimed in claim 8, further comprising:

a buffer section between the second signal selection supply section and the display panel.

10. The organic light emitting display as claimed in claim 8, wherein the second signal selection supply section includes a plurality of selection units, each having a first transistor adapted to be turned-on according to the forward signal for providing a first previous selection signal of the first scan driver as a second selection signal, and a second transistor adapted to be turned-on according to the reverse signal for providing a first next selection signal of the first scan driver as the second selection signal.

11. The organic light emitting display as claimed in claim 10, wherein the first and second transistors are different types from each other.

12. The organic light emitting display as claimed in claim 1, wherein the first scan line includes current scan lines S0, S1*b*, S2*b* . . . Snb, Sn+1, which are connected to respective pixel circuits of the display panel, and the first scan line includes previous scan lines, which are connected to the respective pixel circuits of the display panel.

13. The organic light emitting display as claimed in claim 12, wherein the S0 and Sn+1 scan lines of the first scan line are dummy scan lines, and any pixel connected to the dummy scan lines emits substantially no light.

14. A driver for a display, comprising:

a bi-directional data driver adapted to apply a data signal in both directions;

a first scan driver adapted to receive a forward or reverse signal and to output a first selection signal in a forward or reverse direction to a first scan line of a display panel, wherein the first scan driver includes;

a scan direction controller adapted to receive the forward or reverse signal, and to cause a shift register of a next stage to generate a sequential signal in the forward or reverse direction, a shift register adapted to shift a start signal received by the scan direction controller to generate sequential signals, a first selection signal supply section adapted to receive one of two adjacent signals, and first and second clock signals from the shift register and to provide the first selection signal to the first scan line; and a second scan driver adapted to receive the first selection signal and to output a second selection signal in the forward or reverse direction to a second scan line of the display panel.

15. The driver as claimed in claim 14, wherein the first and second scan drivers are to be positioned at both sides of the display panel, respectively.

16. The display as claimed in claim 14, further comprising:

a buffer section between the first selection signal supply section and a display panel.

17. The display as claimed in claim 14, wherein the scan direction controller includes a plurality of control units, each control unit having a first transistor adapted to be turned-on according to the forward signal to provide the start signal or an output signal of a shift register in a previous stage to a shift register unit, and a second transistor adapted to be turned-on according to the reverse signal to provide the start signal or an output signal of a shift register unit in a next stage to the shift register unit.

18. The display as claimed in claim 17, wherein the first and second transistors are different types from each other.

* * * * *